US006241264B1

(12) United States Patent
Page

(10) Patent No.: US 6,241,264 B1
(45) Date of Patent: Jun. 5, 2001

(54) STEERABLE WHEEL ASSEMBLY WITH DAMPING AND CENTERING FORCE MECHANISM FOR AN IN-LINE SKATE OR ROLLER SKI

(75) Inventor: James S. Page, Belchertown, MA (US)

(73) Assignee: Crosskate, LLC, Florence, MA (US)

( * ) Notice: Subject to any disclaimer, the term of this patent is extended or adjusted under 35 U.S.C. 154(b) by 0 days.

(21) Appl. No.: 09/187,627

(22) Filed: Nov. 6, 1998

(51) Int. Cl.[7] ..... A63C 17/00; A63C 17/04; A63C 1/00

(52) U.S. Cl. ..... 280/11.19; 280/11.22; 280/11.23; 280/11.25; 280/11.27; 280/11.28; 280/842

(58) Field of Search ..... 280/11.22, 11.19, 280/11.23, 11.25, 11.27, 11.28, 842

(56) References Cited

U.S. PATENT DOCUMENTS

| | | | | |
|---|---|---|---|---|
| 3,389,922 | | 6/1968 | Eastin | 280/11.23 |
| 3,749,413 | | 7/1973 | Nicholson | 280/11.2 |
| 3,876,217 | | 4/1975 | Copier | 280/11.23 |
| 4,054,297 | * | 10/1977 | Solimine | 280/11.28 |
| 4,138,127 | | 2/1979 | Kimmell et al. | 280/11.23 |
| 4,363,492 | | 12/1982 | Eriksson | 280/11.1 |
| 4,382,605 | | 5/1983 | Hegna | 280/11.22 |
| 4,392,659 | | 7/1983 | Yoshimoto | 280/11.23 |
| 4,768,793 | | 9/1988 | Spencer | 280/11.1 |
| 4,805,936 | | 2/1989 | Krantz | 280/842 |
| 4,943,075 | | 7/1990 | Gates | 280/842 |
| 5,199,727 | | 4/1993 | Lai | 280/11.28 |
| 5,251,934 | | 10/1993 | Gates | 280/842 |
| 5,312,120 | * | 5/1994 | Wiegner | 280/11.2 |
| 5,330,214 | * | 7/1994 | Brooks et al. | 280/11.27 |
| 5,346,231 | | 9/1994 | Ho | 280/11.2 |
| 5,372,383 | | 12/1994 | Kubierschky | 280/842 |
| 5,411,277 | | 5/1995 | Pratt | 280/11.22 |
| 5,443,277 | | 8/1995 | Kubierschky | 280/11.23 |
| 5,634,652 | * | 6/1997 | Tsai | 280/276 |
| 5,711,539 | | 1/1998 | Tang | 280/11.27 |
| 5,794,955 | * | 8/1998 | Flynn | 280/11.28 |
| 5,860,657 | * | 1/1999 | Kroher | 280/11.22 |
| 5,931,480 | | 8/1999 | Schroeder | 280/11.28 |
| 5,997,018 | * | 12/1999 | Lee | 280/87.042 |

FOREIGN PATENT DOCUMENTS

| | | | | |
|---|---|---|---|---|
| 1428912 | * | 2/1969 | (DE) | 280/11.19 |
| 2145751 | * | 1/1973 | (DE) . | |
| 0169185 | | 1/1986 | (EP) | A62C/5/035 |
| 9000428 | | 1/1990 | (WO) | A63C/17/00 |

OTHER PUBLICATIONS www.grassboard.com currently on the world wide web.

* cited by examiner

*Primary Examiner*—Brian L. Johnson
*Assistant Examiner*—Joselynn Y. Sliteris
(74) *Attorney, Agent, or Firm*—Nutter, McClennen & Fish, LLP

(57) ABSTRACT

A steerable wheel assembly for an in-line skate or roller ski comprises a hollow or dish-shaped wheel (11), a wheel bearing (13), and a wheel support (14) connecting the wheel (11) to a steering pivot (16) which is substantially disposed at a distance measured radially from the rotational axis of the wheel (11) where that distance is greater than the outer radius of the wheel bearing (13) and less than the outer radius of the wheel (11). Steering of the wheel occurs as the user's weight is displaced or the chassis of the device is inclined with respect to the ground toward the desired turning direction. A chassis for an in-line skate or roller ski containing a damping and centering force mechanism which may be used to moderate the behavior of a steering mechanism or suspension mechanism comprises a structural member (21), a damper housing (17), a damper piston (19), a fluid chamber (24), and a centering force mechanism (18).

16 Claims, 20 Drawing Sheets

STEERABLE WHEEL ASSEMBLY WITH DAMPING AND CENTERING FORCE MECHANISM FOR AN IN-LINE SKATE OR ROLLER SKI

BACKGROUND OF THE INVENTION

The invention pertains to a steerable wheel assembly which provides steering control through weight displacement and optionally provides centering and damping forces which moderate the steering behavior.

Many wheeled devices have been invented which benefit or could benefit from the ability to steer by weight displacement. Some of the most widely known are for sport and recreation, such as roller skates. Although very functional and popular, roller skates steer using a bulky mechanism which requires wheels to be in pairs. This limits overall performance in terms of speed, handling, suitable terrain, and makes them heavier than ideal.

Performance gains and wider usage have come from the introduction of in-line skates. These are faster, more maneuverable, and potentially lighter. However, they do not actually steer by weight displacement (although they may at first appear to do so). Steering of in-line skates is accomplished by actually scrubbing the wheels and twisting the skate relative to its direction of motion. This works well only with wheel configurations that have a relatively short wheelbase (shorter than the users foot), or that have central wheels which are lower than the other wheels, creating an effective wheelbase which is short enough to allow turning—a configuration commonly referred to as rocker. For configurations with only two wheels and/or longer wheelbases, steering by scrubbing the wheels is much more difficult. Examples of such devices include land skis, roller skis, and some of the recently introduced all terrain "off-road" in line skates. Typically with these devices steering is accomplished by step turning which is clumsy and difficult. Handling could be greatly improved with weight displacement steering similar to downhill skis.

A wide variety of mechanisms exist for steering individual wheels of sporting devices by weight displacement. However, the known methods have drawbacks which have prevented them from being adopted for in-line skates and land skis as discussed below.

U.S. Pat. No. 4,382,605 (to Hegna, 1983) relies on a chassis comprised of multitude of flexible members which bend and result in steering when the user's weight is shifted. This is complex from a manufacturing standpoint, and potentially unwieldy when used on a foot mounted device such as an inline skate, roller ski, or the like.

The mechanism described in U.S. Pat. No. 3,876,217 (to Copier, 1975) and the similar mechanism used in practice on wheeled land surfing boards both allow the front wheel of a device to pivot about an axis defined by a pivot means necessarily located relatively in front of the front wheel axle. This mechanism is unwieldy because the user's weight is applied to the frame from behind the front wheel, which requires substantially large and potentially heavy supporting members connecting the weight bearing portion of the frame to the pivot means, and additional members to transfer forces between the pivot means and the axle of the front wheel. In both these cases these members form a fork around the front wheel. With the fork, and the additional length of frame required to connect to it, the overall device weight is substantially greater than if the frame could connect directly to the axles of the wheels.

U.S. Pat. No. 4,138,127 (to Kimmell and Stansbury, 1979) describes a mechanism which uses cradle members to provide steering action to wheels of an in-line wheeled device. These cradle members also require a load bearing frame structure which extends to the side of the wheel away from where the user's weight is principally applied in order to create a pivot means with the cradle; for example, for a front wheel, the frame must extend beyond the front of the wheel even though the user's weight is primarily located behind the front wheel. For a device with large wheels, this type of mechanism would require a potentially unwieldy frame structure, similar to those described above.

U.S. Pat. No. 5,372,383 (to Kubierschky, 1994) describes a mechanism which is largely incorporated into the inside of an in-line wheel to provide steering by weight displacement. This mechanism has several disadvantages. As in the case of U.S. Pat. No. 4,138,127, this mechanism requires link members which could be unwieldy for devices with large wheels. Secondly the total amount of steering pivot action obtainable is small because it is limited to the maximum angle obtainable between an axle shaft and an axle tube that surrounds it. For a device with a relatively long wheel base, this would limit the user to large radius turns. Finally, the wheel bearings must be large enough to fit around the axle tube, which would in many cases, prohibit the use of industry standard, inexpensive small skate bearings.

U.S. Pat. Nos. 5,199,727 (to Lai, 1993) and 5,443,277 (to Kubierschky, 1995) describe mechanisms for the same purpose which are both fully contained inside the wheel, and eliminate some of the bulk of the previously mentioned methods. Although they do not require the use of bulky links or cradles, these mechanisms have the following disadvantages:

a) Some if not all of the functional parts of these mechanisms must fit within the inner face of the wheel bearings (as the wheel is viewed from the side). This again necessitates the use of wheel bearings which are larger, heavier and probably more expensive than standard skate bearings.

b) These mechanisms do not lend themselves to the use of standard, inexpensive skate or skateboard wheel bearings for the steering pivot elements because of space constraints.

c) Both mechanisms are limited in total pivot range because of arrangements (similar to U.S. Pat. No. 5,372,383) of a stationary shaft body enclosed by a hollow axle tube body which pivots with the wheel.

d) Finally, the mechanism of U.S. Pat. No. 5,199,727 is subject to having harmful grit and other foreign matter enter into the mechanism unless an elaborate sealing mechanism is added.

Accordingly, several objects and advantages of the present invention are:

a) to provide a mechanism for steering by weight displacement or inclination with respect to the ground which fits within the radius of the wheel and allows the use of standard skate bearings (or virtually any reasonable bearing or bushing) for the primary wheel bearing or bearings as well as for the steering pivot means.

b) to provide a steering mechanism which allows a much larger steering pivot range than is provided for by other mechanisms that can fit inside a wheel of a skate or roller ski.

c) to provide a steering mechanism which can easily be sealed against grit and other foreign material.

d) to provide a steering mechanism which adds the minimum possible weight.

e) to provide a steering mechanism which only requires a supporting frame on one side of the wheel (i.e. with a cantilevered axle) to further reduce the device complexity and structural weight required.

f) to provide a steering mechanism that fits primarily inside the cavity of the wheel of a device so that it is well protected from potentially destructive impact, and to provide a damping and centering force mechanism to moderate steering behavior which fits inside the frame of the device for the same reason.

g) to provide a steering mechanism which can easily be coupled with an adjustable damping and centering force mechanism capable of creating a damped, self centering system to improve handling and maneuverability.

h) to provide a damping and centering force mechanism that can be incorporated into the chassis of a device to be easily coupled with a steering mechanism or other mechanism while adding minimal weight and complexity to the device.

i) to provide a steering mechanism which can be easily disabled by the user so that the rotational axis of the wheel is temporarily fixed with respect to the frame of the device.

j) to provide a sporting device such a skate or roller ski with a simple chassis that is disposed to one side of the foot to provide maximum strength and ground clearance, ease of manufacture, and minimum weight and complexity.

Still further objects and advantages will become apparent from a consideration of the ensuing description and drawings.

SUMMARY OF THE INVENTION

In accordance with the present invention a steering mechanism comprises a wheel, a wheel bearing, and a wheel support means which is pivotally connected to a chassis by a pivot means substantially contained inside the wheel, providing improved maneuverability with a compact mechanism. A damping and centering force mechanism internal to the chassis of a sporting device which may be used in conjunction with a steering mechanism, suspension mechanism or other mechanisms to provide improved handling is comprised of a damper housing incorporated into the chassis, a piston means, and optionally a centering force means such as a spring. A sporting device to be used in pairs with one mounted to each foot, such as a skate or roller ski comprises two or more wheels and a chassis with primary structural members which run along one side of the foot, providing maximum strength, ground clearance, simplicity, light weight, and ease of manufacture.

BRIEF DESCRIPTION OF THE DRAWINGS

In the drawings, closely related figures have the same numerals, but different alphabetic suffixes.

FIG. 1A shows a typical roller ski without steering. FIG. 1 B shows an all terrain in line skate without a steering mechanism, which is typical. FIG. 1C shows a land surfing device.

FIG. 2A shows an isometric view. FIG. 2B shows a right side view. FIG. 2C shows a left side view.

FIG. 3A shows an isometric view of the steering mechanism connected to the wheel that it steers. FIG. 3B shows a sectioned view of this mechanism to illustrate the interconnection of the parts. FIG. 3C shows a top view with part of the wheel removed for clarity. FIG. 3D shows a right side view including the relationship between the steering axis and the tire patch. FIG. 3E shows a top view with the mechanism in a left turn configuration. FIG. 3F shows a top view with the mechanism in a right turn configuration.

FIG. 7A shows the whole sporting device, and FIG. 7B shows a partial view of the chassis with a cutaway to show the details of the internal damping and centering force mechanism. This figure also shows an optional restoring force means similar to the steering centering force means of FIG. 5.

DETAILED DESCRIPTION OF THE INVENTION

Figure 1A:
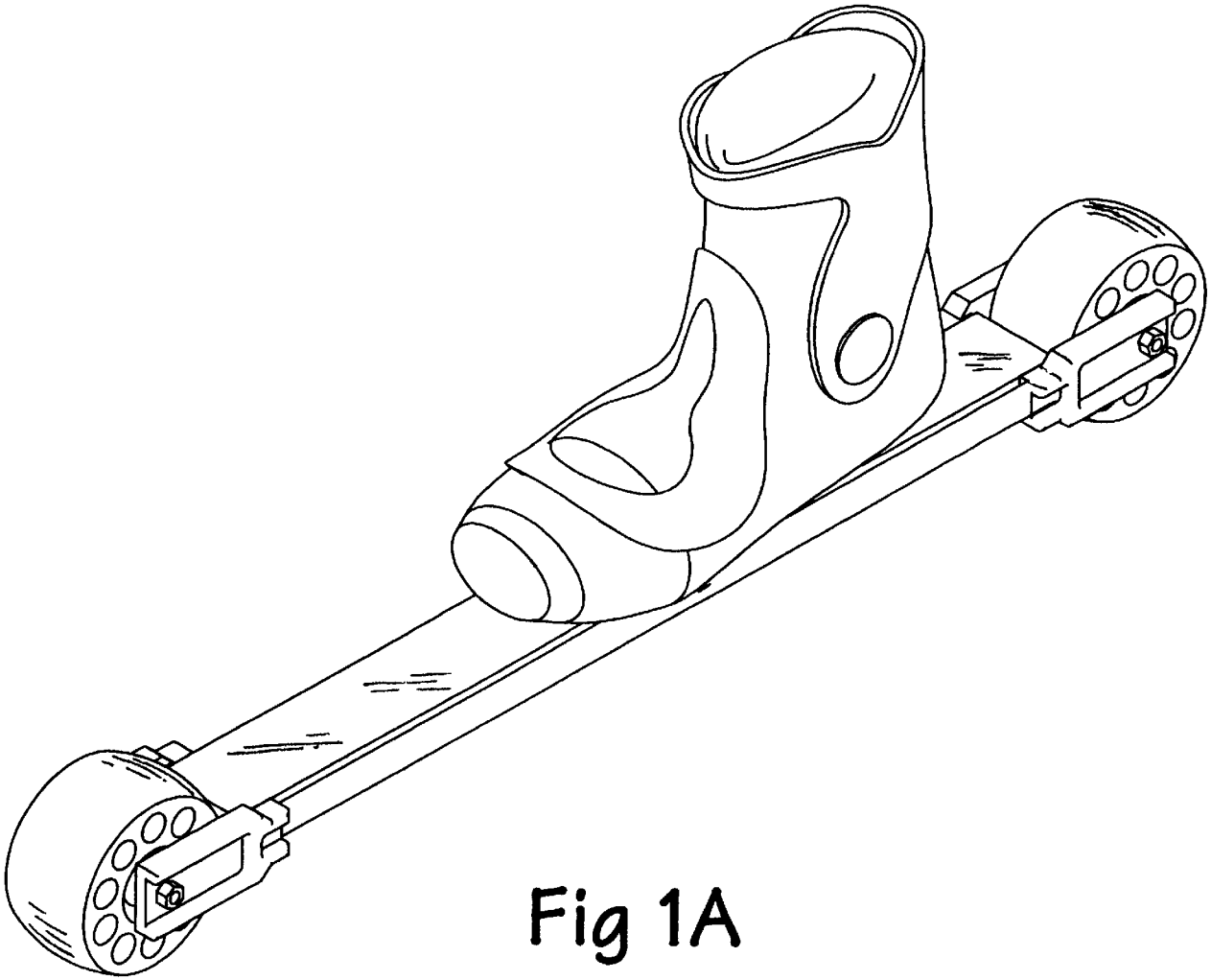
Fig 1A PRIOR ART
FIGS. 1A to 1C show conventional sporting devices either with a conventional steering mechanism or no steering mechanism depending on the device.
Figure 1B:
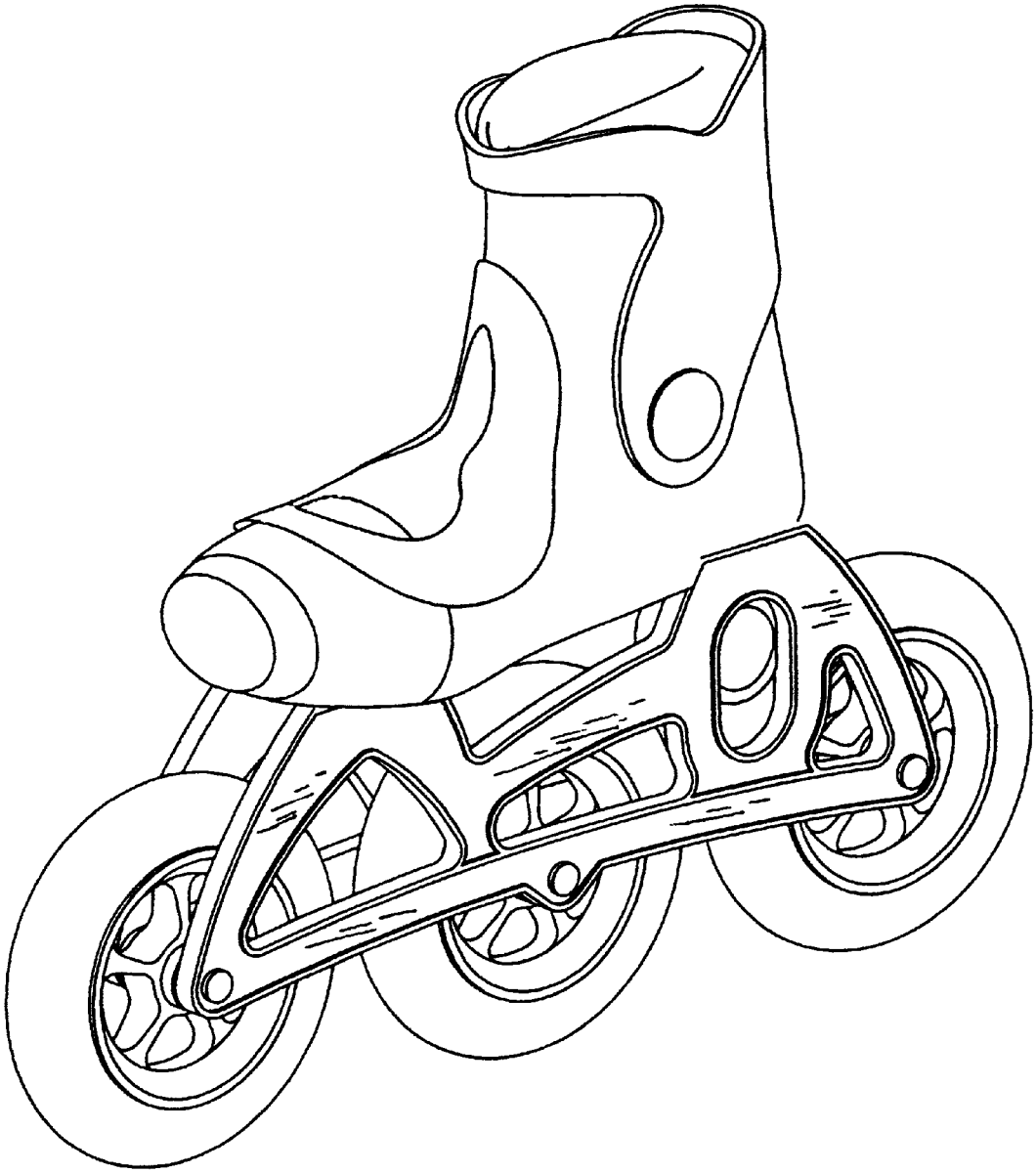
Fig 1B PRIOR ART
Figure 1C:
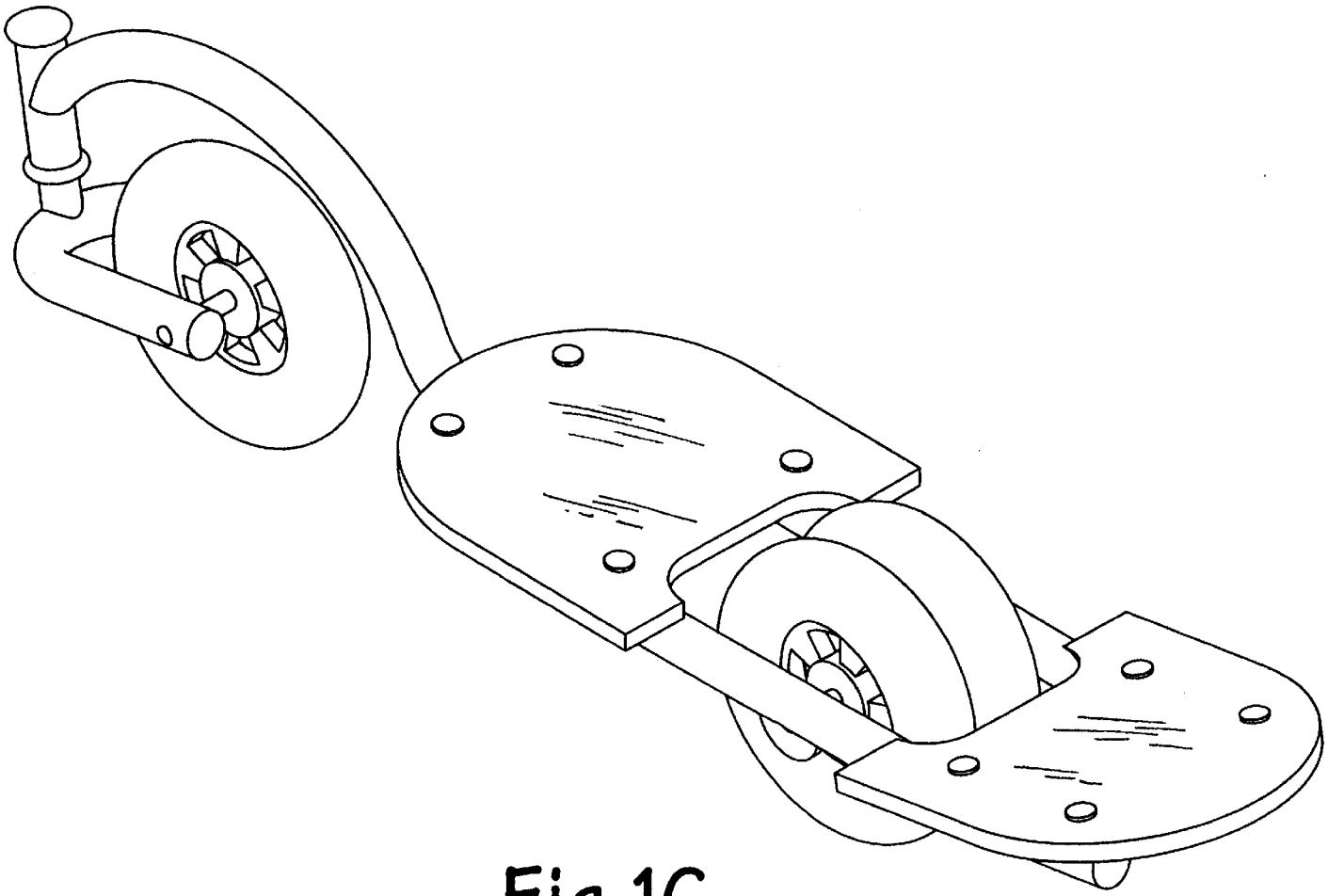
Fig 1C PRIOR ART

A survey of the prior art demonstrates the need for a compact, lightweight, robust steering mechanism for use in sporting devices. FIGS. 1A to 1C show existing sporting devices that either do not have steering mechanisms or have steering systems that could be improved.

FIG. 1A shows a conventional roller ski. This device does not employ an explicit steering mechanism. Turns are executed by the user by lifting up one ski and putting it down again in a different direction. The direction of both skis is changed one after the other to execute a "step turn". Such devices are widely used specifically for Nordic ski training. However, their overall use is limited due to their difficult handling characteristics. Specifically, their inability to turn gracefully at speed as a downhill ski does makes them dangerous and difficult to use. The situation would be greatly improved if they had a mechanism that allowed them to turn as the user transferred his or her weight. Additionally, it would be desirable to tailor the steering response to the user's input and to bumps in the environment. This can be accomplished with a system which applies damping and centering forces to the wheel being steered.

FIG. 1B shows an all terrain in line skate. This device does not have an existing steering mechanism. Steering is accomplished either by step turning as described above, or by twisting the skate while the wheels are still in contact with the ground which can be difficult to do with a skate with such a long wheelbase. This results in poor handling and can lead to crashes, especially on narrow trails where the user's feet must be kept very close together. The usefulness and enjoyment from this type of device would be greatly improved if the user could lean to steer when moving quickly along narrow winding paths.

FIG. 1C shows a land surfing device. This device currently employs a weight displacement operated steering mechanism. For this type of application, the steering ability is essential to the operation of the device. The existing steering mechanism works, but it is unwieldy because it requires large frame members that extend far beyond the front of the front wheel. This arrangement also makes the device heavier and less aesthetic than if it employed a compact steering mechanism such as the one described in this invention. It would also be desirable to tailor the steering response with predictable damping and centering forces.

Each of the devices described above would be improved with the use of a compact, lightweight, robust weight displacement steering mechanism coupled with a damping and centering force mechanism. A list of other devices that could also employ such mechanisms includes, but is not limited to roller skates, ice skates, skate-skis, in-line skates, land or snow surfing devices, farm equipment, and industrial machinery.

The sporting device proposed in this invention was designed to overcome many of the disadvantages of existing skates, land skis and the like. Specifically, it allows the user to traverse terrain at speed with quick alpine ski like turns (which is especially useful on down hill sections) while still providing for various forms of locomotion on level and uphill sections. The requirement of step turning is eliminated, as is the need to twist the skate to turn.

Figure 2A:
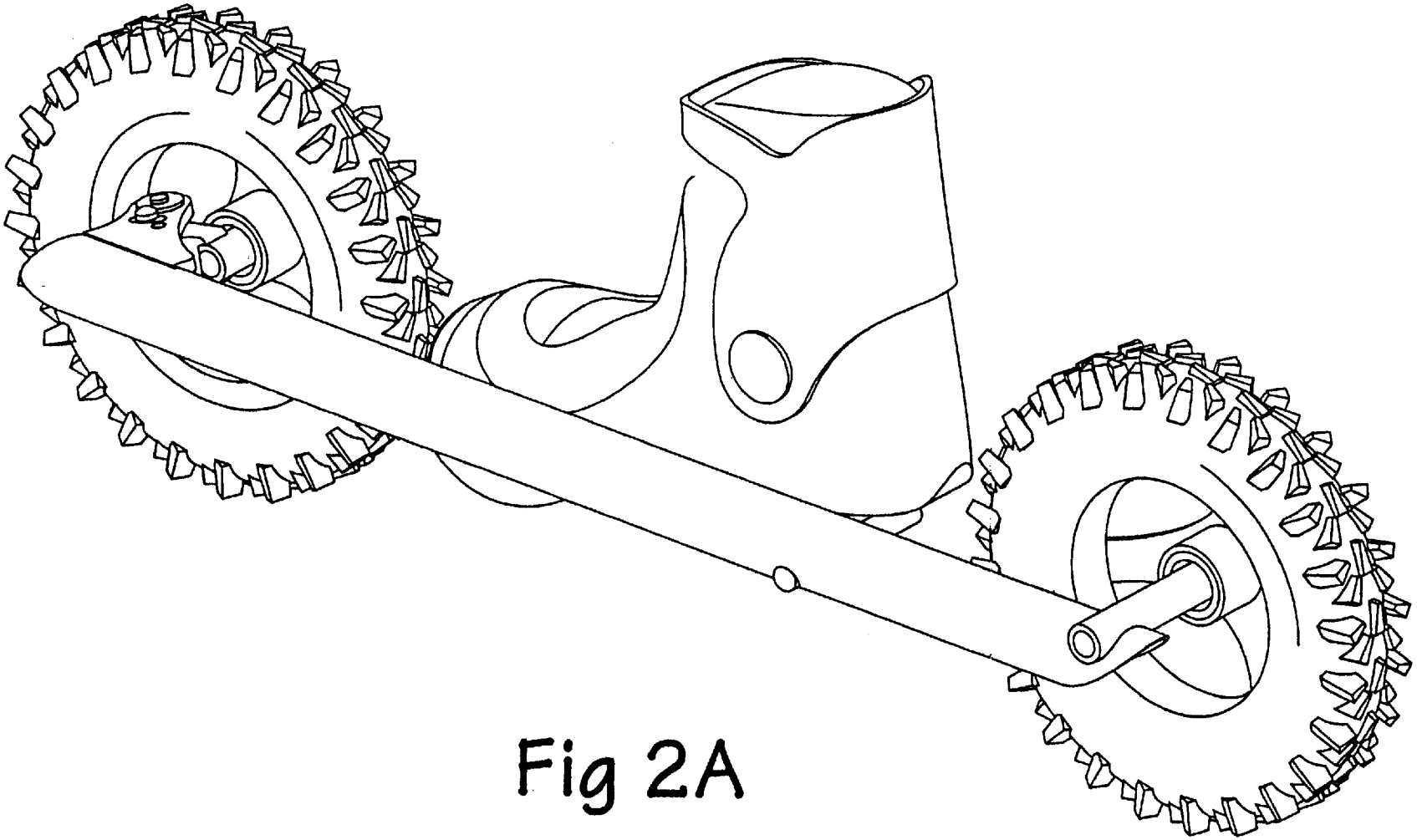
FIGS. 2A to 2C show the preferred embodiment of a ski/skate sporting device configured with the steering, damping, and centering force mechanisms of the present invention. In these figures, the wheel being steered is the front wheel, and the damping/centering force mechanism is coupled with the steering mechanism. The device is configured for a left foot.
Figure 2B:
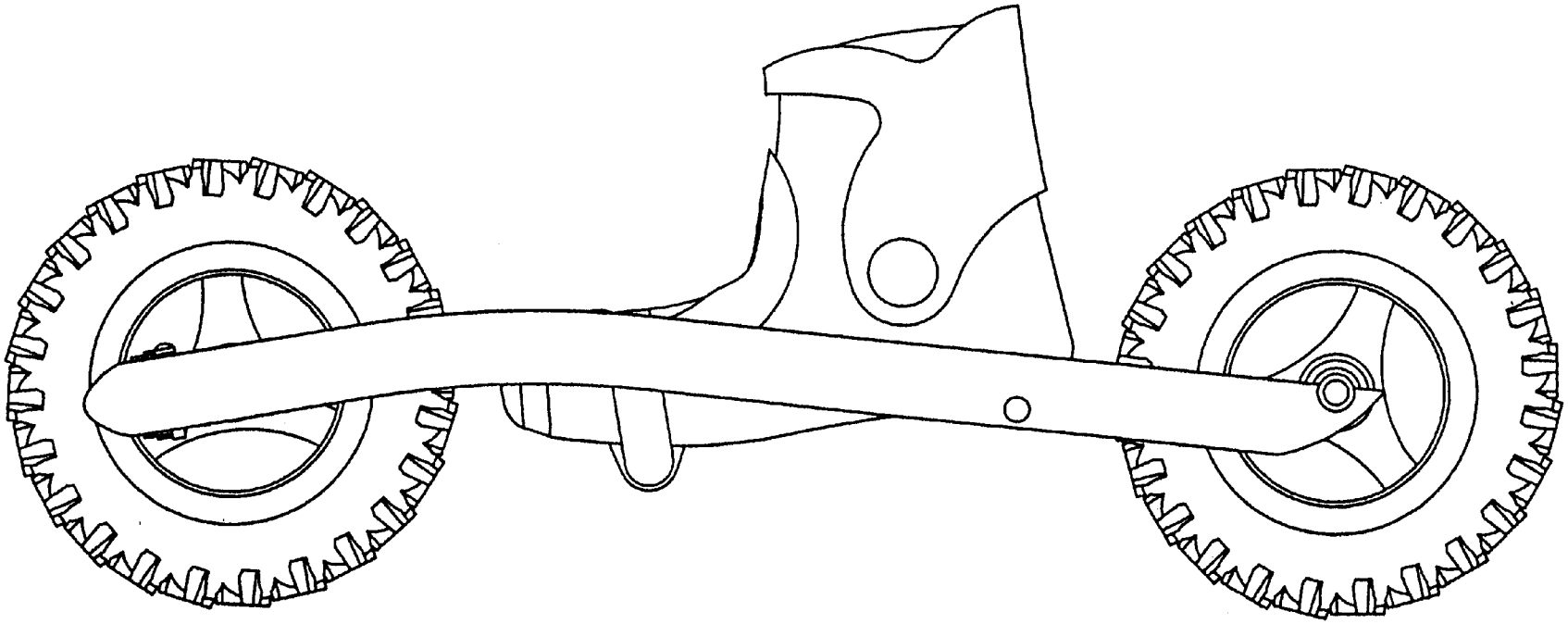
Figure 2C:
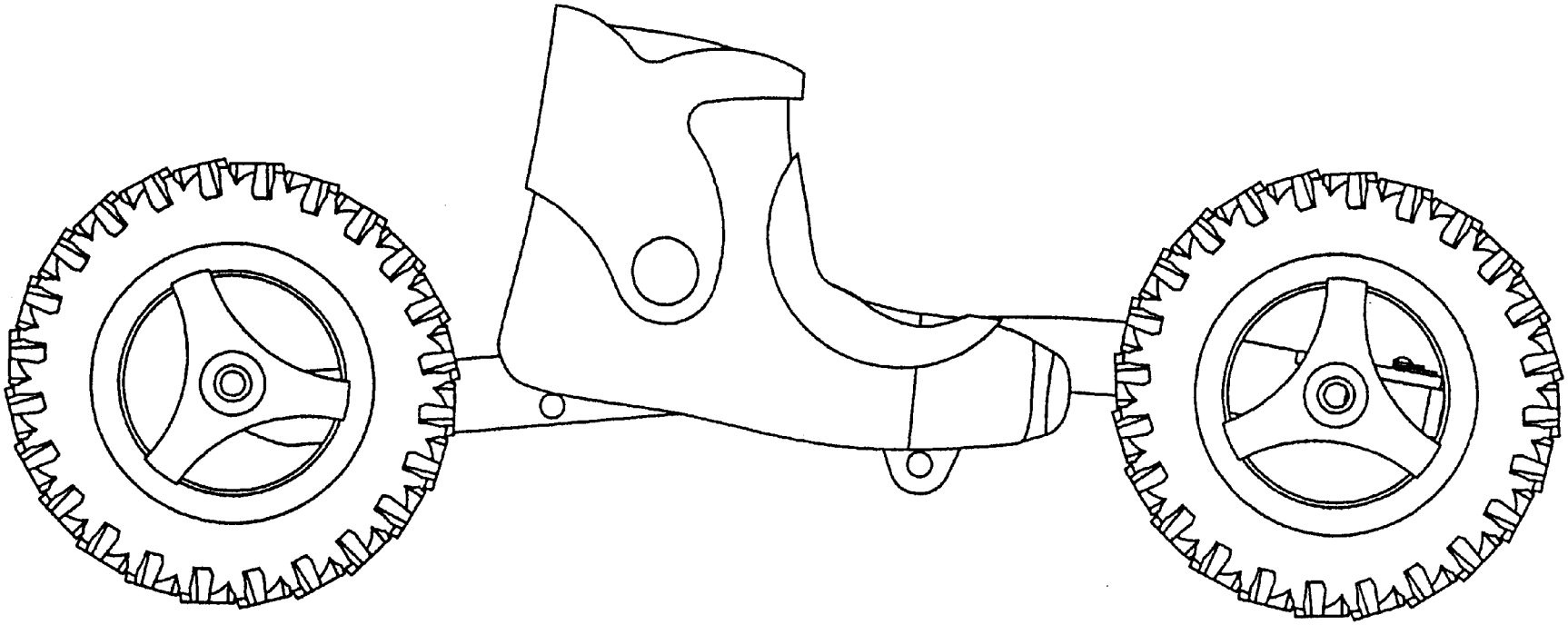

The preferred embodiment of the present invention is shown in FIGS. 2A to 2C. This embodiment is in the form of a skate-ski sporting device which is used in pairs, with one worn on each foot. The primary mode of use is a motion similar to Nordic or Randoneé skiing. (Randoneé skiing is similar to Nordic skiing, but the heels of the boots have the possibility of being locked down for better control on extended downhills). In general, the heel of each foot is free to lift somewhat so a graceful striding motion can be used to generate forward motion when on flat ground or when going up hill. One or both of the wheels may contain a one way clutch or ratchet mechanism to aid in forward propulsion. With the use of such a clutch, when the user strides forward, the propelling skate will not roll backward. Additionally, an outward push skating type motion (similar to ice skating) can also be used for propulsion when terrain merits. The user steers at will by leaning toward the desired turning direction. This is particularly useful when speed is attained. Steering is accomplished via a mechanism which is described below. Steering response is modified with an optional damping and centering force mechanism which is also described below. Additionally, there may be mechanisms to disable the steering mechanism and/or lock the heel down to the device for more control under certain conditions. Brakes may be included on the device for added control and safety, though they are not shown in the figures for clarity.

A sporting device configured as described above would be more maneuverable and be usable on a wider range of terrain than the previously existing roller ski and skate devices.

The mechanisms of the present invention also have utility when used with devices other than the preferred embodiment described above. The following describes the steering mechanism alone so that its component parts can be understood and used in various applications. A typical embodiment of the steering mechanism of the present invention is illustrated in FIGS. 3A to 3G. These figures show a front wheel of a sporting device as the wheel being steered.

The present invention is designed to cause steering action based upon the user's weight displacement and lean of the device with respect to the ground.

The mechanism has a wheel 11 with a hollow or dish shaped cross section. A tire 10 is mounted around the perimeter of wheel 11. A wheel support means 14 includes an axle portion and a structural connection portion. Wheel 11 is rotatably mounted to wheel support 14 with a wheel bearing means 13. Wheel 11 is thus able to rotate with respect to the device about a wheel rotation axis 31 (FIG. 3C) and allows the device to move with respect to the ground. Optionally, a one-way clutch means, roller clutch, or ratchet mechanism may be included as part of or next to wheel bearing 13 so that the wheel will roll forward but not backward, and a backward push on the device will result in forward propulsion.

A rigid chassis 21 is defined as the fixed body or assembly which all other parts move relative to. The structural connection portion of wheel support 14 is rotatably mounted to chassis 21 by a kingpin rod 15 and a steering pivot means 16.

The basic operation of the steering mechanism is as follows: for the front wheel steering configuration of FIGS. 3A to 3F, when weight is applied to chassis 21 and chassis 21 is tilted to the side during forward motion, wheel 11 turns toward the direction of tilt. This results in steering of the sporting device.

Figure 3A:
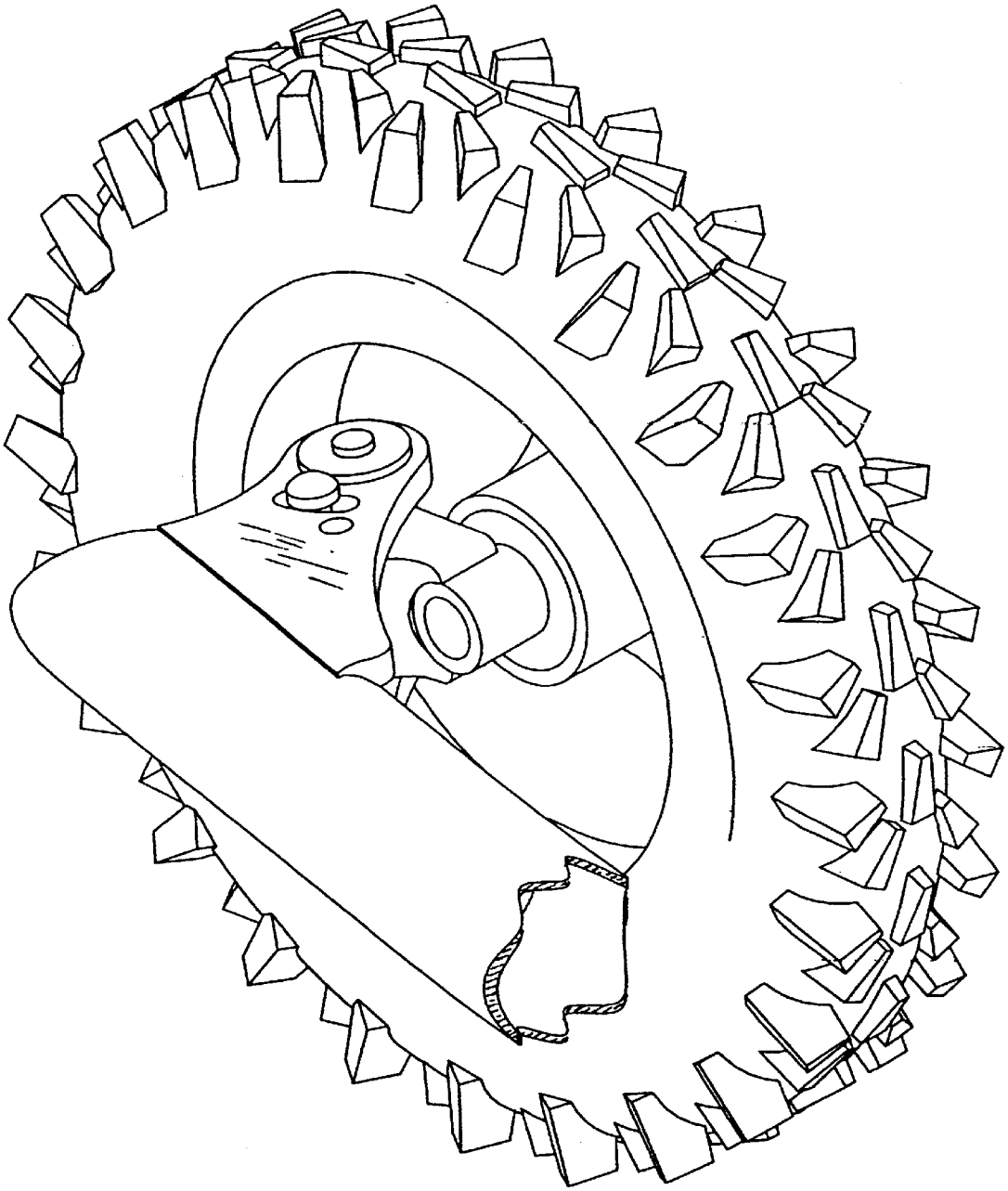
FIGS. 3A to 3F show various aspects of the preferred embodiment of a steering mechanism with steering bearings contained within the perimeter of the wheel being steered. These Figs show the mechanism as it applies to a front wheel of a sporting device.
Figure 3B:
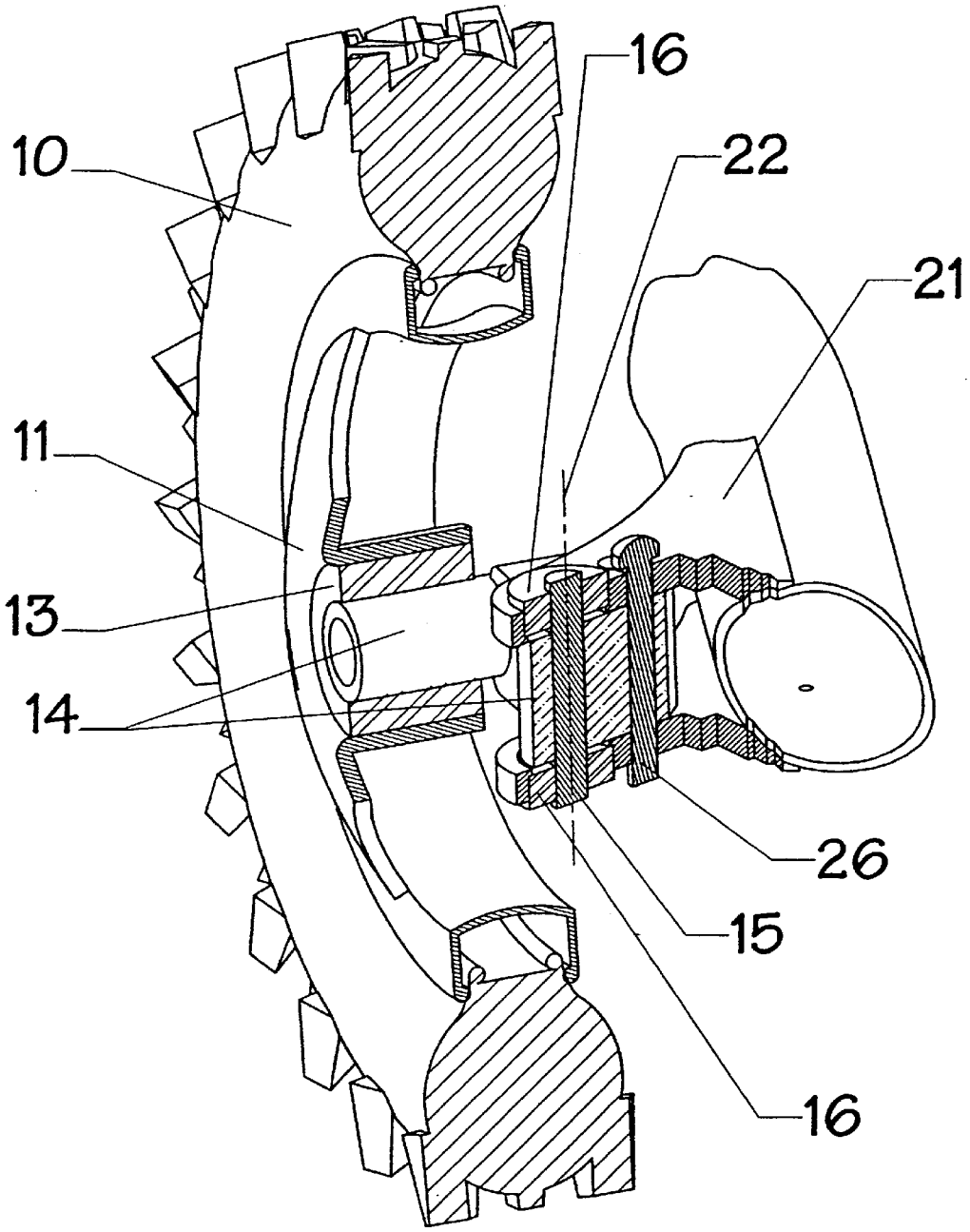
Figure 3C:
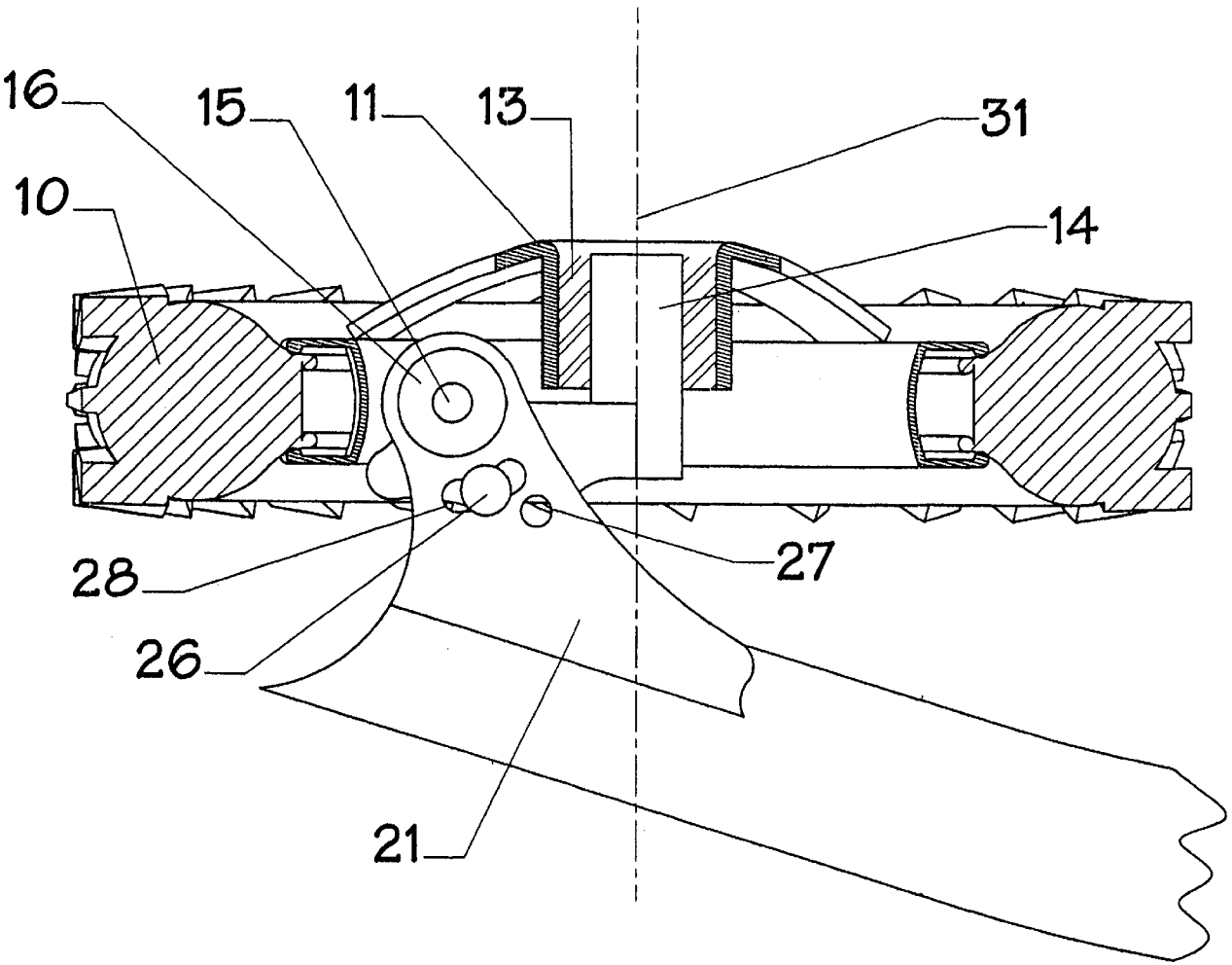
Figure 3D:
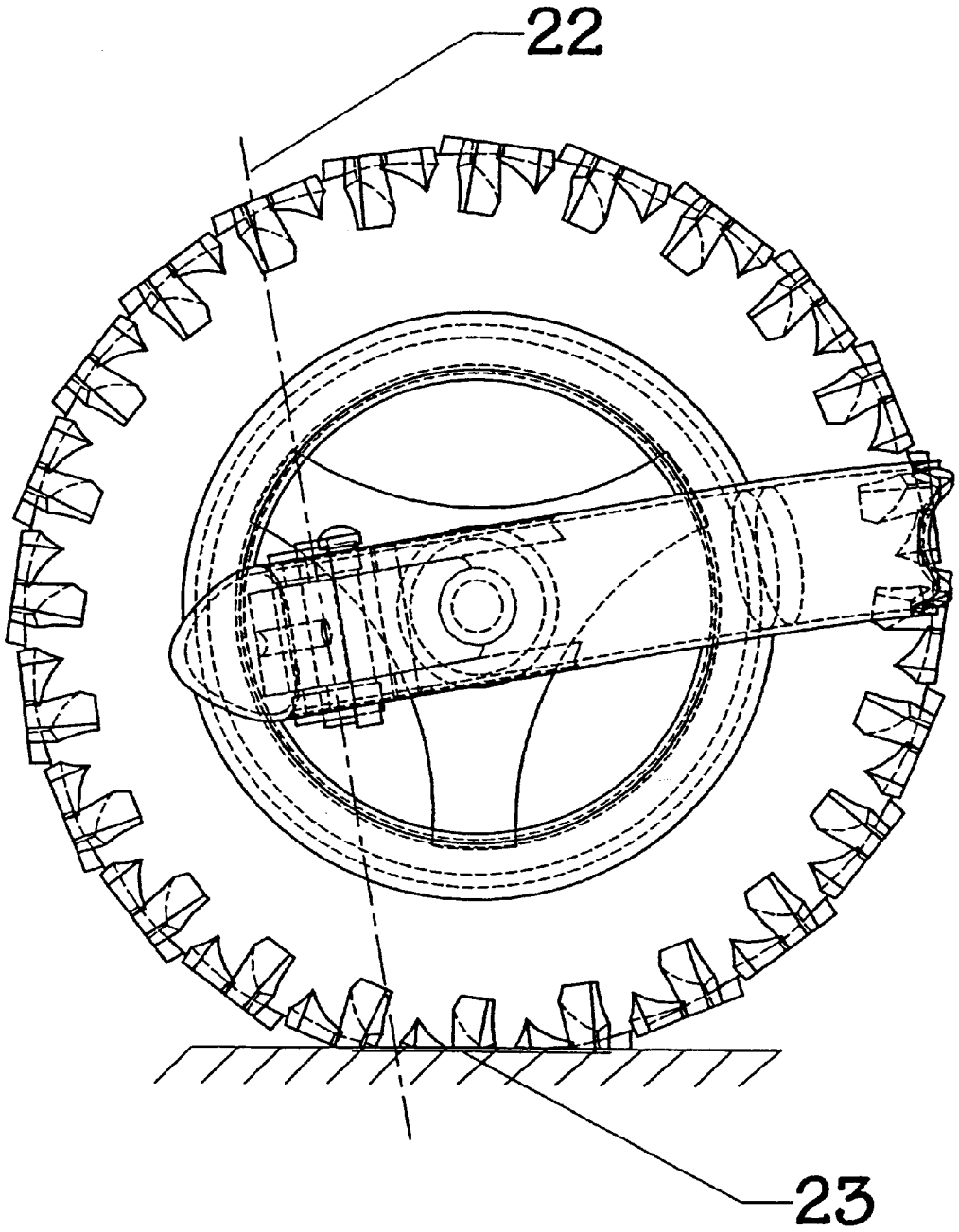
Figure 3E:
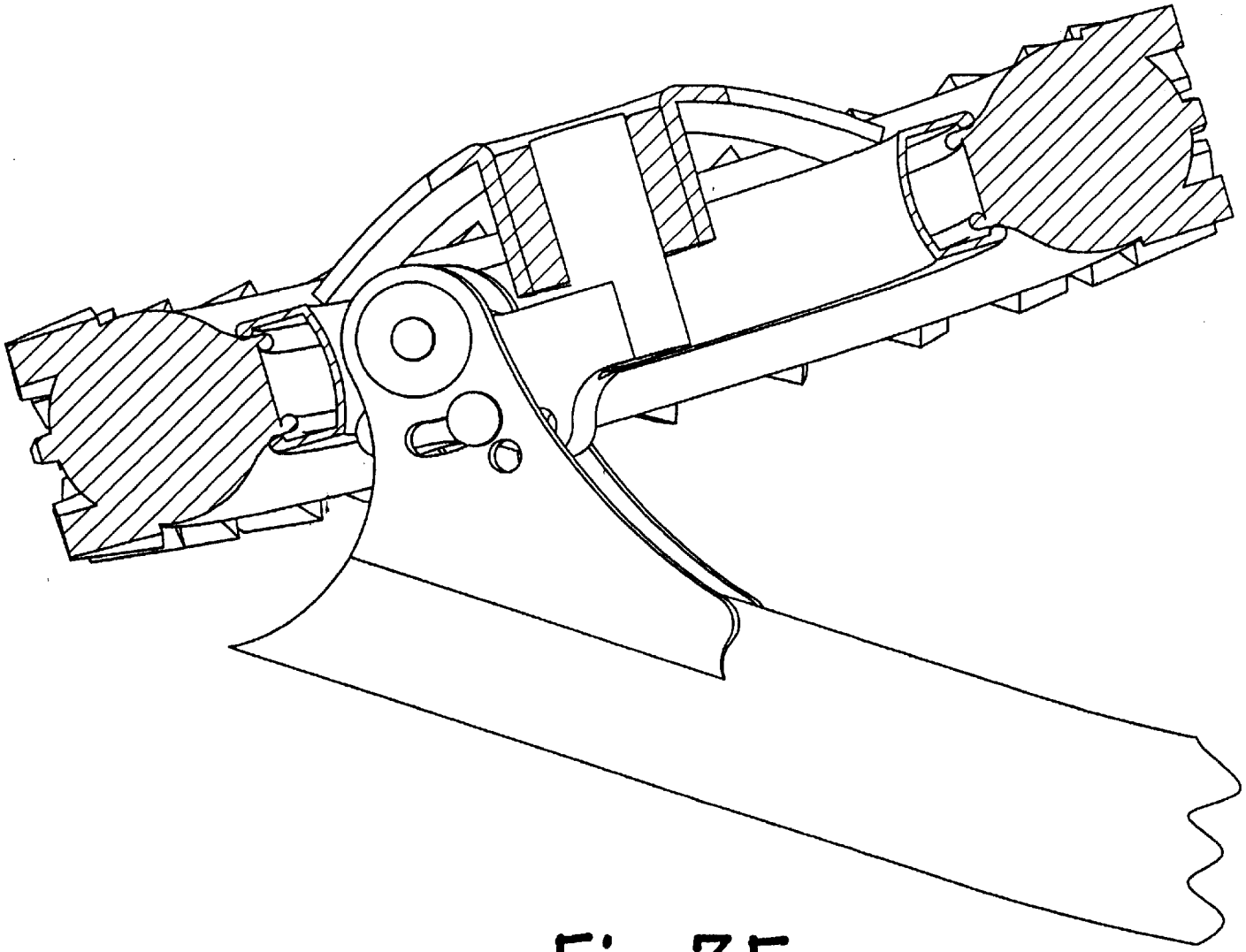
Figure 3F:
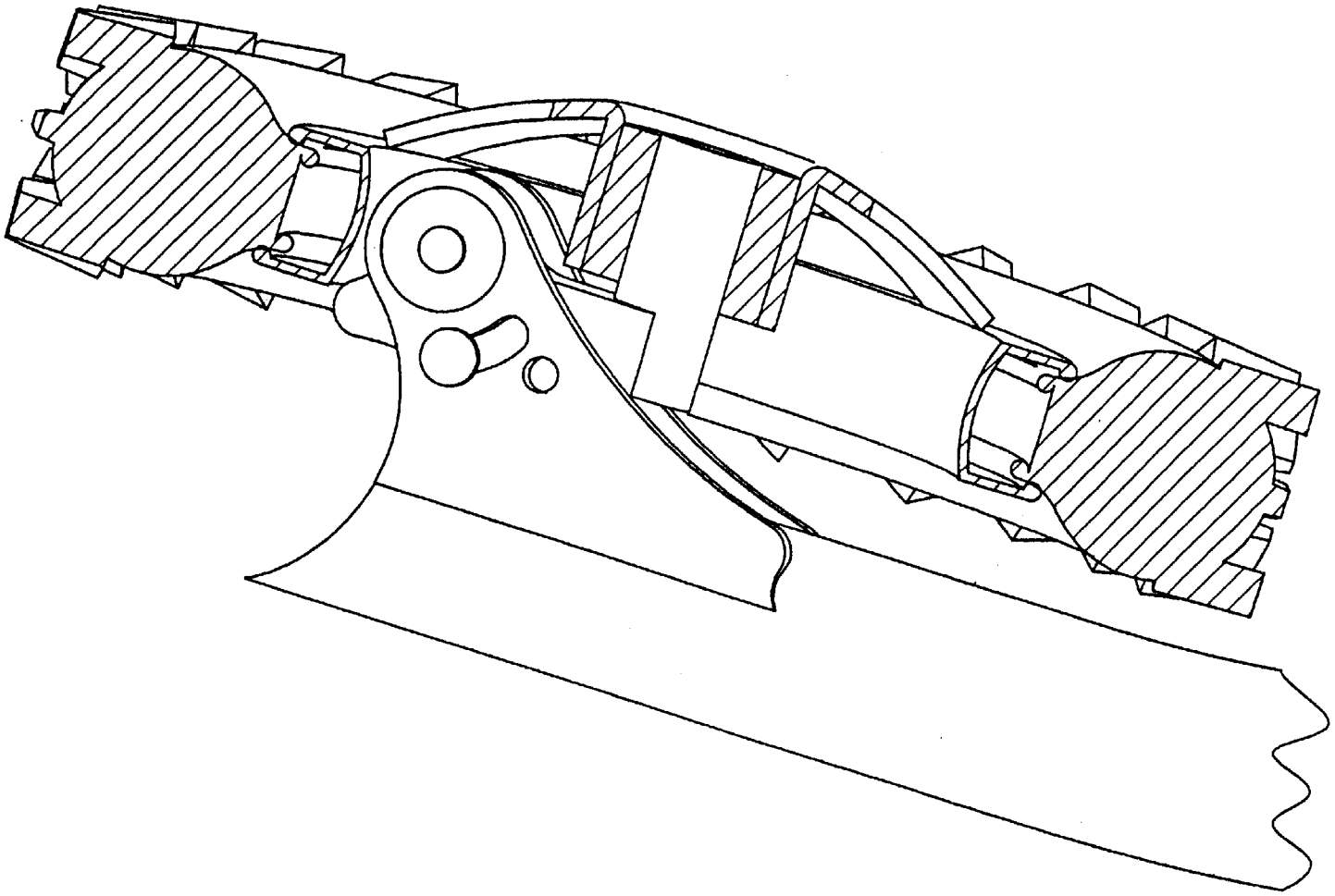

The operation of the steering mechanism of my above invention relies upon steering axis 22 (FIGS. 3A, 3B, and 3D), which is defined by the orientation of steering pivot 16. Wheel 11 pivots relative to chassis 21 about steering axis 22. A tire patch 23 is the region where tire 10 deforms as it makes contact with the ground, as shown in FIG. 3D. For the steering of a front wheel as shown in FIGS. 3A to 3F, steering axis 22 extends rearwardly and downwardly and intersects the plane of the ground in front of the center of tire patch 23. This configuration of axis 22 relative to chassis 21 and tire patch 23 ensures that the wheel turns in the desired direction when weight is applied and chassis 21 is inclined.

Figure 5:
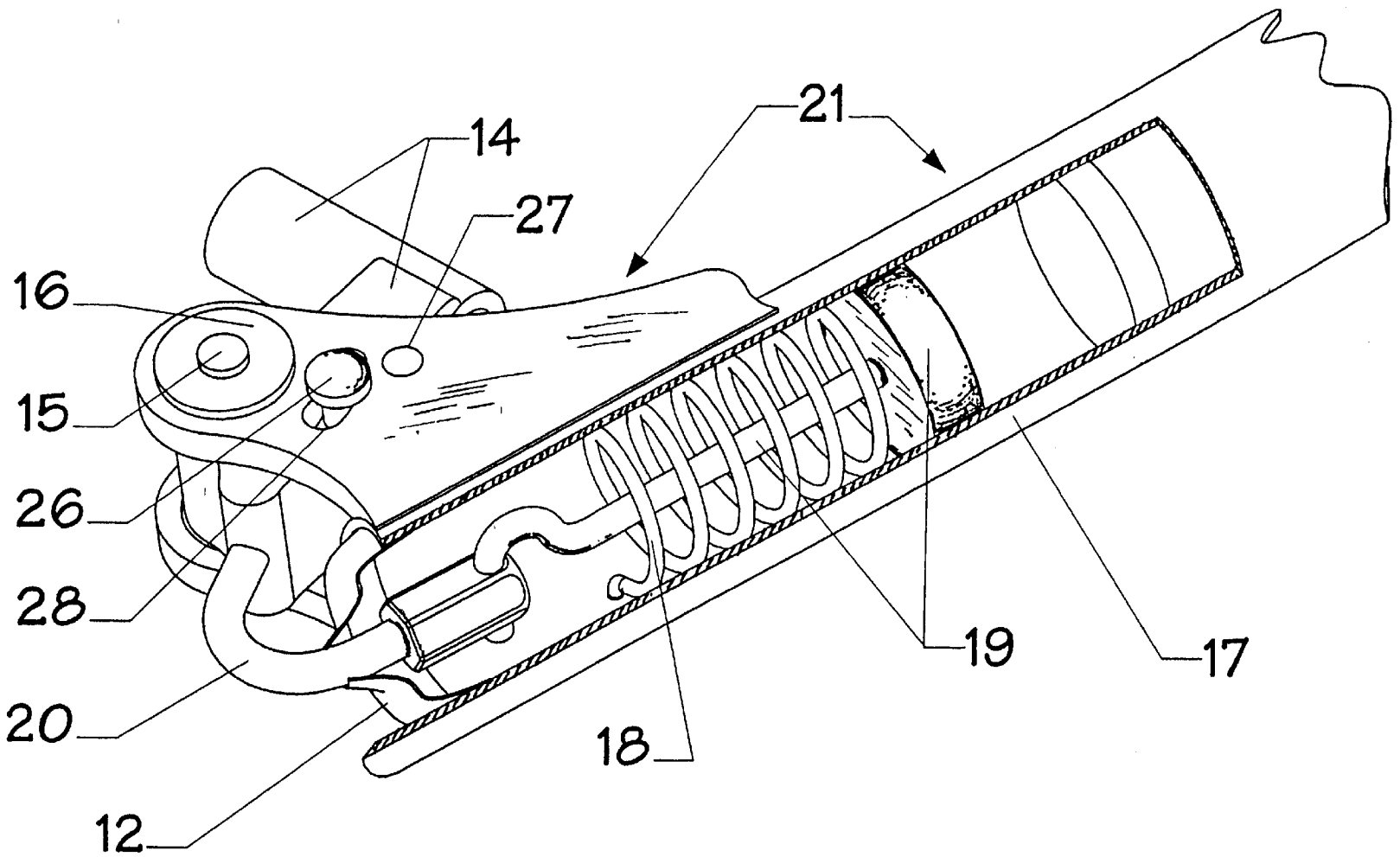
FIG. 5 shows an Isometric view of the steering mechanism coupled with the damping and centering force mechanism and integrated with part of the chassis of a sporting device. This view shows part of the chassis cut away to show the arrangement of the internal components.

Several other notable features of this type of steering mechanism include its ability to accommodate a wide range of bearings for both wheel bearing 13 and steering pivot 16, its wide steering range when compared with other in-wheel steering mechanisms, its ability to accommodate a cantilevered axle, and its ability to include a steering lockout mechanism. The ability to use standard bearing types is made possible by the hollow or dish shape of wheel 11, and is advantageous because it reduces the cost of the device, provides a robust pivot, and allows easy replacement. The wide steering range is made possible by the fact that wheel support 14 (and the axle portion thereof) pivot with the wheel 11, rather than being stationary and limiting the pivot angle as in several of the prior art examples. This wide range allows tighter turns to be executed than with other in-wheel steering mechanisms. The use of a cantilevered axle allows the chassis of the device to be as simple and inexpensive as a single tube or other member which runs along only one side of the device. The steering lockout mechanism is facilitated by the easy access to the parts of the steering mechanism. The user has access to a steering stop pin 26, which can be placed either in a steering limit track 28 to allow steering action, or in a steering lockout hole 27 to disable steering action (FIGS. 3B, 3C and 5). While this provides one example of a simple lockout mechanism, a variety of other mechanisms are possible.

FIG. 3B shows that in the preferred embodiment, chassis 21 has a "yoke" feature (i.e. two arms) which extend around both sides of wheel support 14. If kingpin 15 is to be supported at both ends (either fixed or in bearings), the "yoke" feature may be incorporated into the part of chassis 21 that supports wheel support 14 as shown in FIGS. 3A to 3F; alternatively, wheel support 14 may have a "yoke" feature which reaches around part of chassis 21 (this configuration is not shown in the figures). The "yoke" feature may be omitted entirely if kingpin 15 is cantilevered. Kingpin 15 may be fixed to chassis 21 so that wheel support 14 rotates with respect to it, or it may be fixed to wheel support 14 and rotate with respect to chassis 21. The configuration chosen depends upon strength considerations, size of the desired steering pivot, as well as the arrangement of any other damping and centering force mechanisms.

Figure 3G:
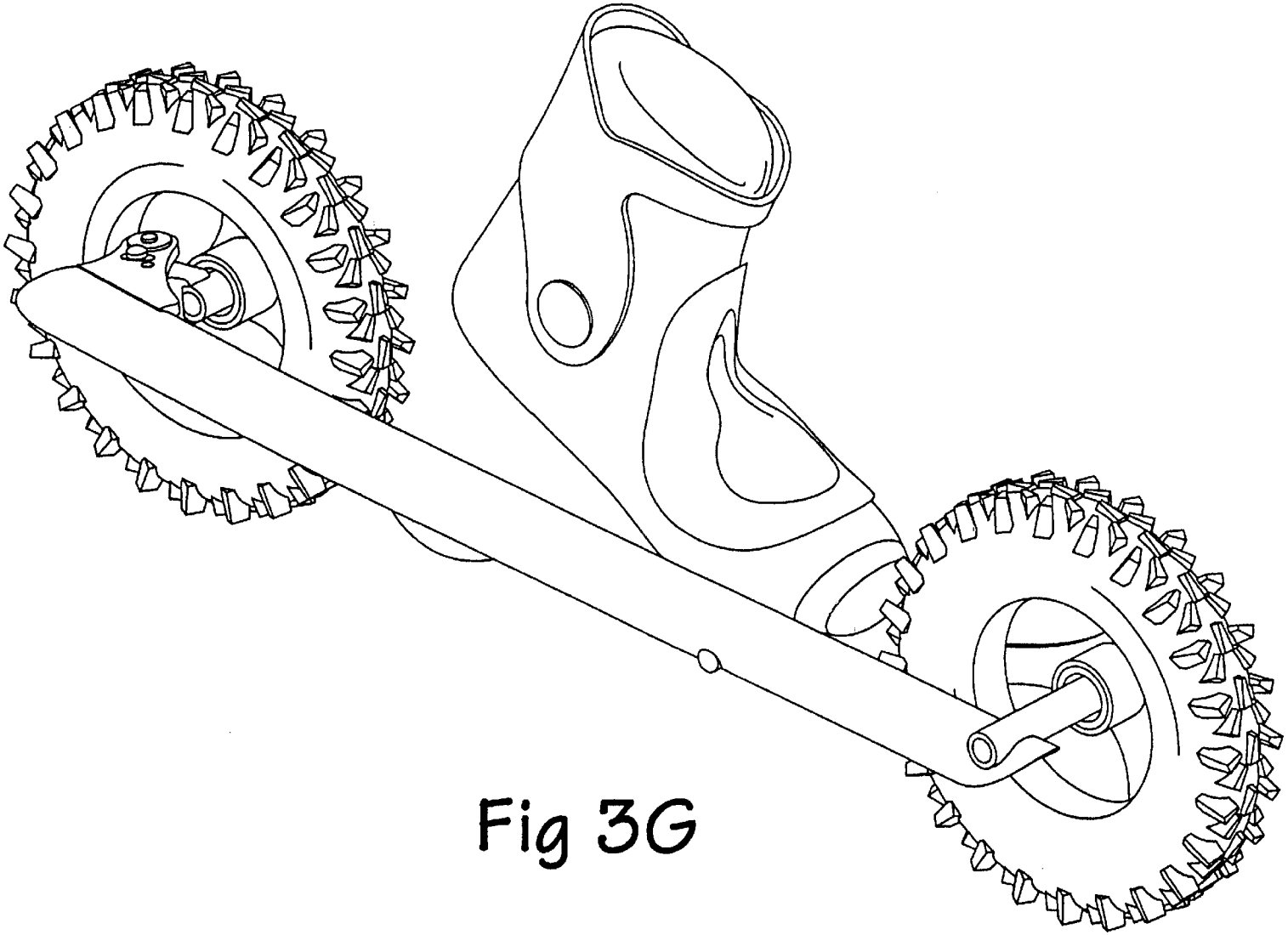
FIG. 3G shows an isometric view of a sporting device with the preferred mechanism configured to steer the rear wheel.

FIG. 3G shows an embodiment of the steering mechanism configured to steer a rear wheel of a sporting device. The elements of the mechanism are the same as in the above description for front wheel steering. In addition to front only or rear only steering, it is also feasible to configure a sporting device with both front and rear wheels that steer using this type of mechanism.

In the case of a steerable rear wheel, a steering axis similar to axis 22 extends downwardly and forwardly, most likely intersecting the ground behind the center of the tire patch. This condition is required for the system to be stable without an additional centering force means (i.e. to naturally return to a neutral steering position during forward motion when no tilt of the chassis is applied).

Figure 4:
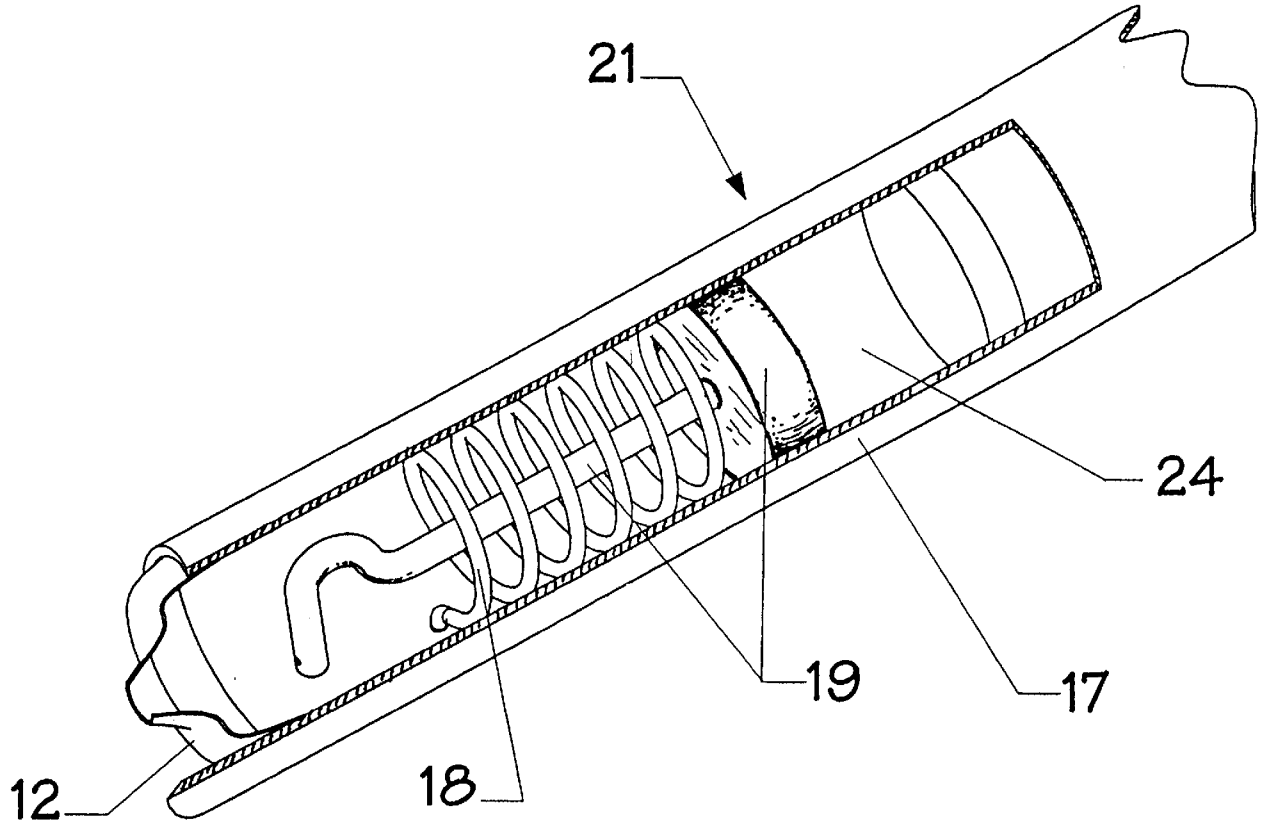
FIG. 4 shows an isometric view of a damping and centering force mechanism integrated with the chassis of a sporting device. Part of the chassis has been cut away to show the damper elements.

FIG. 4 shows a damping and centering force mechanism incorporated into the chassis of a sporting device. FIG. 5 shows a similar mechanism coupled with the steering mechanism of FIGS. 3A to 3G. It is often desirable to add biasing or centering forces to a steering system in addition to those provided by gravity and the configuration of the steering axis. The specific handling characteristics for either a front or rear wheel are dependent upon the centering forces applied by any centering force means in addition to the centering forces applied by virtue of gravity and the geometrical configuration of the system. Additional centering forces keep the wheel centered if it is lifted from the ground, and can modify steering behavior to suit specific terrain conditions. Centering forces can be provided through the use of springs, elastomer elements, or any other element that provides centering force when its dimensions are changed. In FIGS. 4 and 5, a coil spring is shown as a centering force means 18. Note that the spring 18 is attached at both ends so that it provides centering forces when extended as well as when compressed. Also, centering forces can be asymmetrical or have an asymmetrical relationship to the angular displacement of the wheel. This can compensate for any relative ease of leaning a device one way versus the other and further tailor the steering response to the user's needs.

It is also desirable to add damping forces (resistance proportional to the velocity of steering movement ) to the system. These moderate steering movement, preventing steering wobble, uncontrolled oscillation, and unwanted steering movement. In the preferred embodiment of the invention, damping is accomplished through the movement of a damper piston 19 in a damper housing 17, which results whenever wheel 11 is rotated about steering axis 22 with respect to chassis 21. The steering and damping mechanisms interact through a steering link 20 which is rigidly connected to kingpin rod 15 and rotatably connected to piston 19. As the assembly is moved, the angle of piston 19 changes with respect to housing 17, but the same small amount of clearance between piston 19 and the inner bore of housing 17 is maintained because of the spherical surface of the perimeter of piston 19.

Housing 17 is sealed at least on one end, and possibly on both ends. A fluid chamber 24 is defined as a fluid filled volume within which piston 19 moves. When piston 19 moves, a pressure differential is created in the fluid ( in this case air ) on either side of it. A limited path between areas of high and low pressure is provided, either in the form of a small amount of clearance between the spherical surface of piston 19 and housing 17, or a port through piston 19, or a port in one of the walls of housing 17. For the device shown in FIGS. 4 and 5 it is assumed that there is an appropriate amount of clearance between piston 19 and housing 17 and therefore no port is shown. The limited clearance or small port causes the fluid flow to be throttled, so kinetic energy from the system is dissipated (damped). Adjustments to the size of the port or to the fit between piston 19 and housing 17 change the magnitude of the damping forces generated. A damper sealing boot 12 represented in FIG. 4 is a flexible membrane, preferably made of rubber, which prevents the entry of grit and debris into housing 17.

The preferred embodiment uses this air damping configuration for the following reasons:

a) it conveniently can use part of chassis 21 as a housing for the damper system (housing 17).

b) it creates minimal visual clufter.

c) it adds few extra components.

d) it adds minimal extra weight because of a) and c) and because air serves as a lightweight damping fluid.

It should be noted however, that an effective embodiment can also be created using oil or another fluid as a damping medium, or using a wide variety of other damping mechanisms.

The damping and centering force mechanism of the present invention can also be incorporated into a variety of devices either in conjunction with a steering mechanism, or for use with other mechanisms.

Figure 6A:
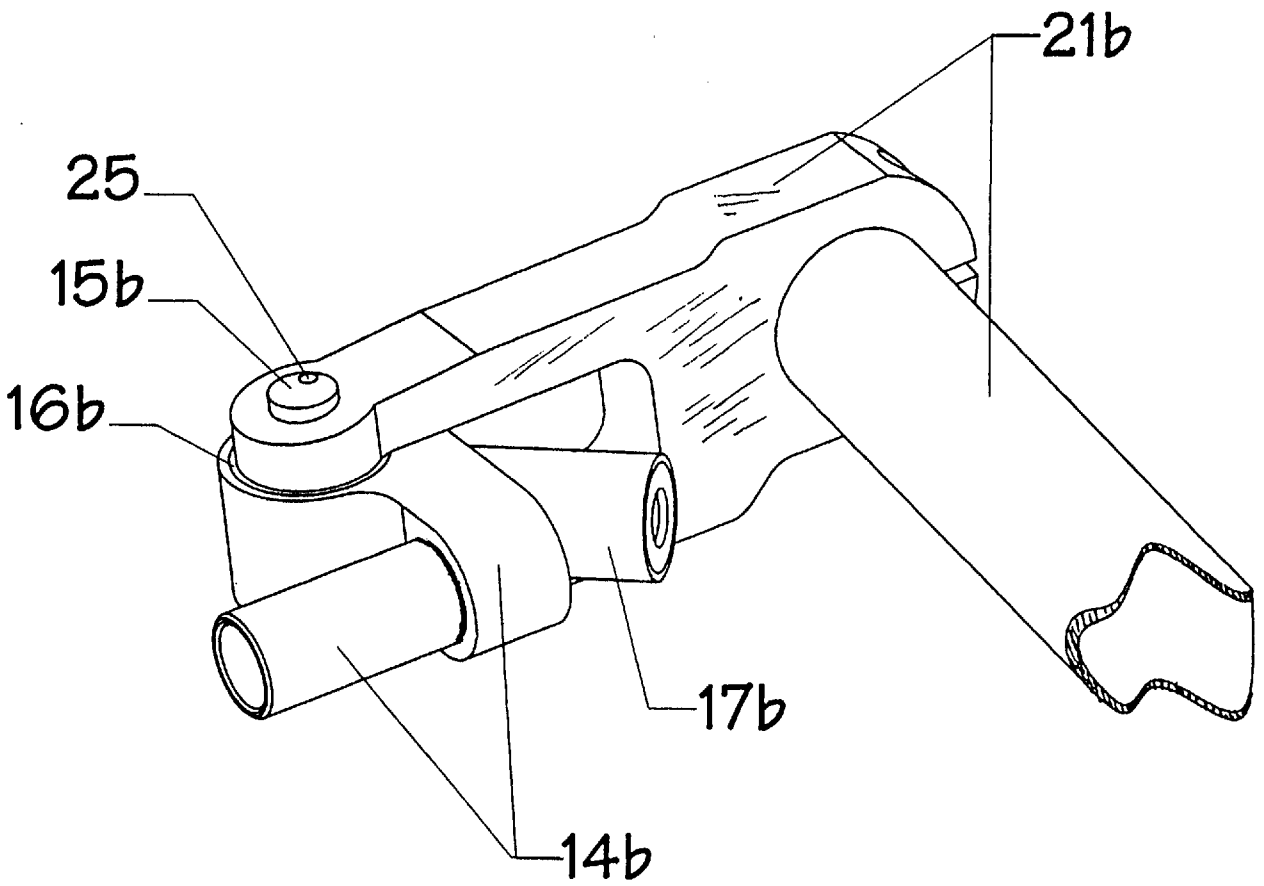
FIGS. 6A–6C show an alternate embodiment of the steering mechanism coupled with an alternate embodiment of the damping and centering force mechanism.
Figure 6B:
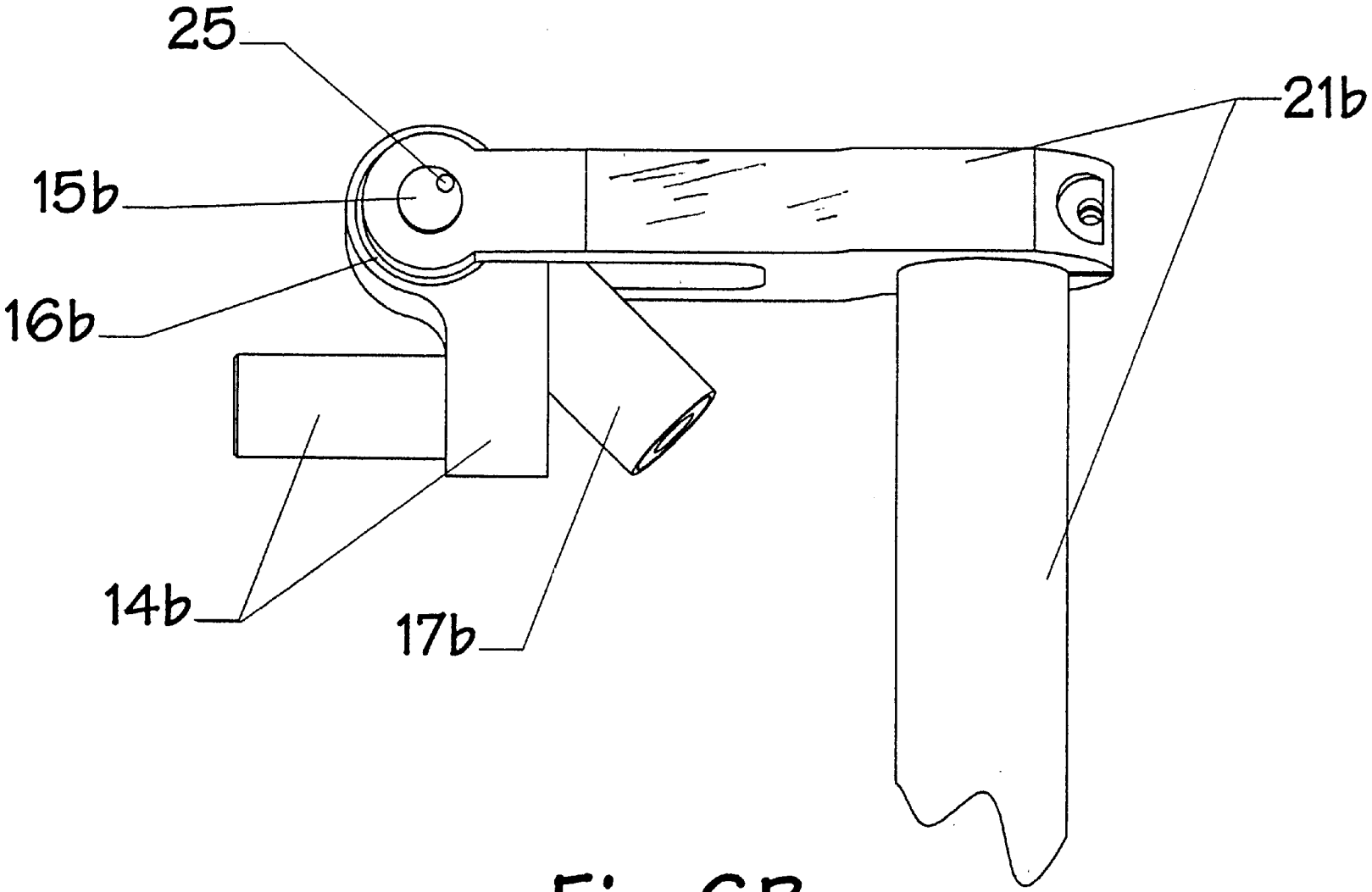
Figure 6C:
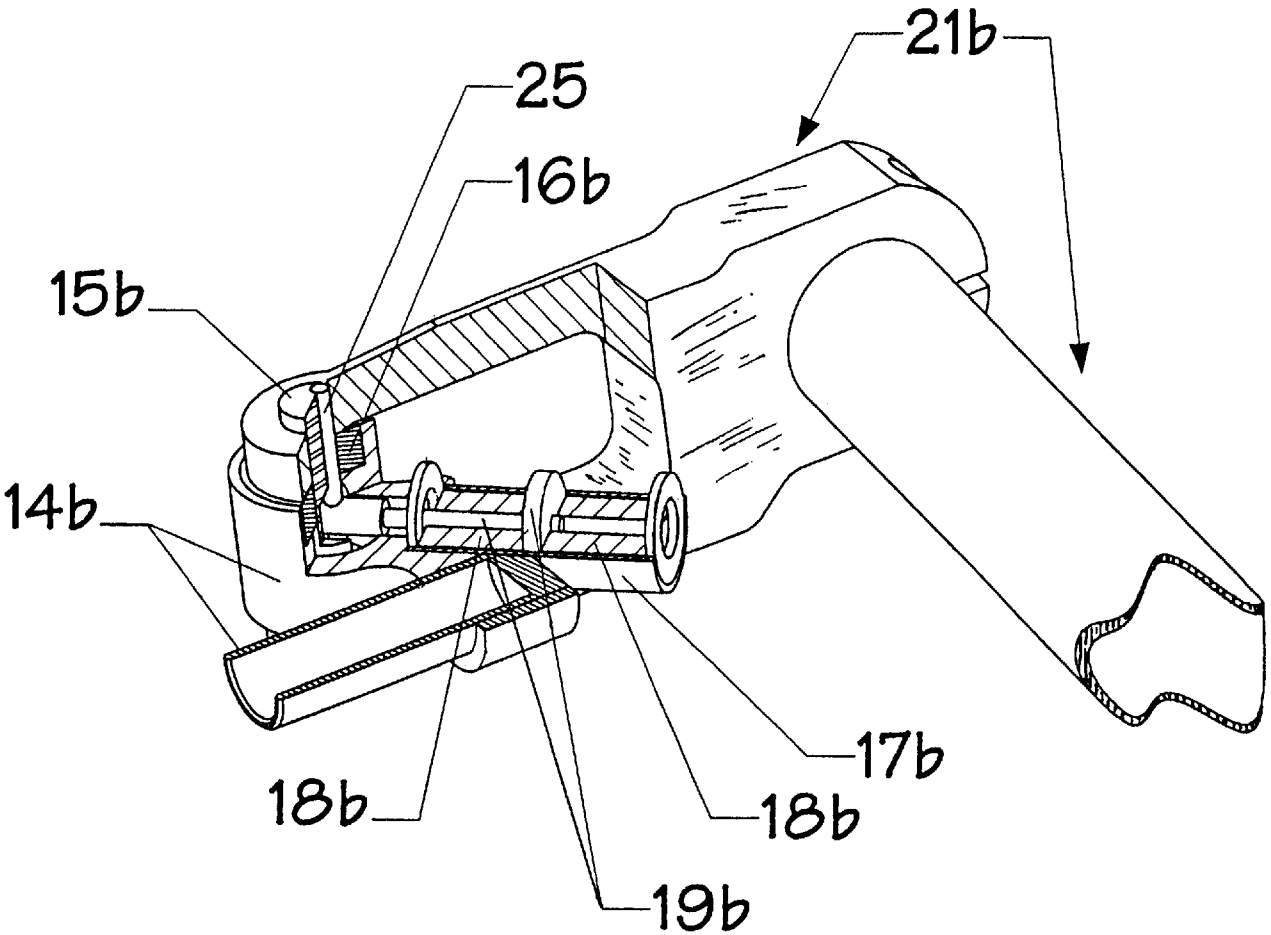

FIGS. 6A to 6C show an embodiment in which the steering centering force and damping mechanisms have been incorporated into wheel support 14*b* instead of residing in the chassis. Counterpart elements to those depicted in other Figures are depicted in FIGS. 6A, 6B and 6C with a "b" suffix. Thus, for example, elements 15*b* and 21*b* of FIGS. 6A, 6B and 6C correspond to elements 15 and 21 depicted in FIGS. 3B, 3C and 5. Although this is not the preferred embodiment, it is a possibility. In this embodiment kingpin rod 16*b* is rotatably connected to piston 19*b* via a connecting pin 25. This embodiment employs 2 sets of centering elastomers 18*b,* one on either side of piston 19*b*. Note that wheel support 14*b* has a cylindrical feature, housing 17*b,* which essentially serves the same purpose as housing 17 in FIGS. 4 and 5, and contains piston 19*b* and centering elastomers 18*b*.

Either of these embodiments of the steering mechanism can be used to enhance the performance of a variety of devices because of their compactness, light weight, and steering ability.

It is possible to create a sporting device that uses the steering mechanism without damping and centering force mechanism, or with a different damping and centering force mechanism. If damping is not needed, piston 19 and fluid chamber 24 are not required. If centering forces are not required, centering force means 18 is not required.

It is also possible to create a sporting device that uses the damping and centering force mechanism in conjunction with a different steering mechanism. It is also possible to create a sporting device that uses the damping mechanism to control a suspension mechanism or many other mechanisms. Furthermore, it is possible to create a sporting device that uses multiple damping and centering force mechanisms for different purposes within the same device.

Figure 7A:
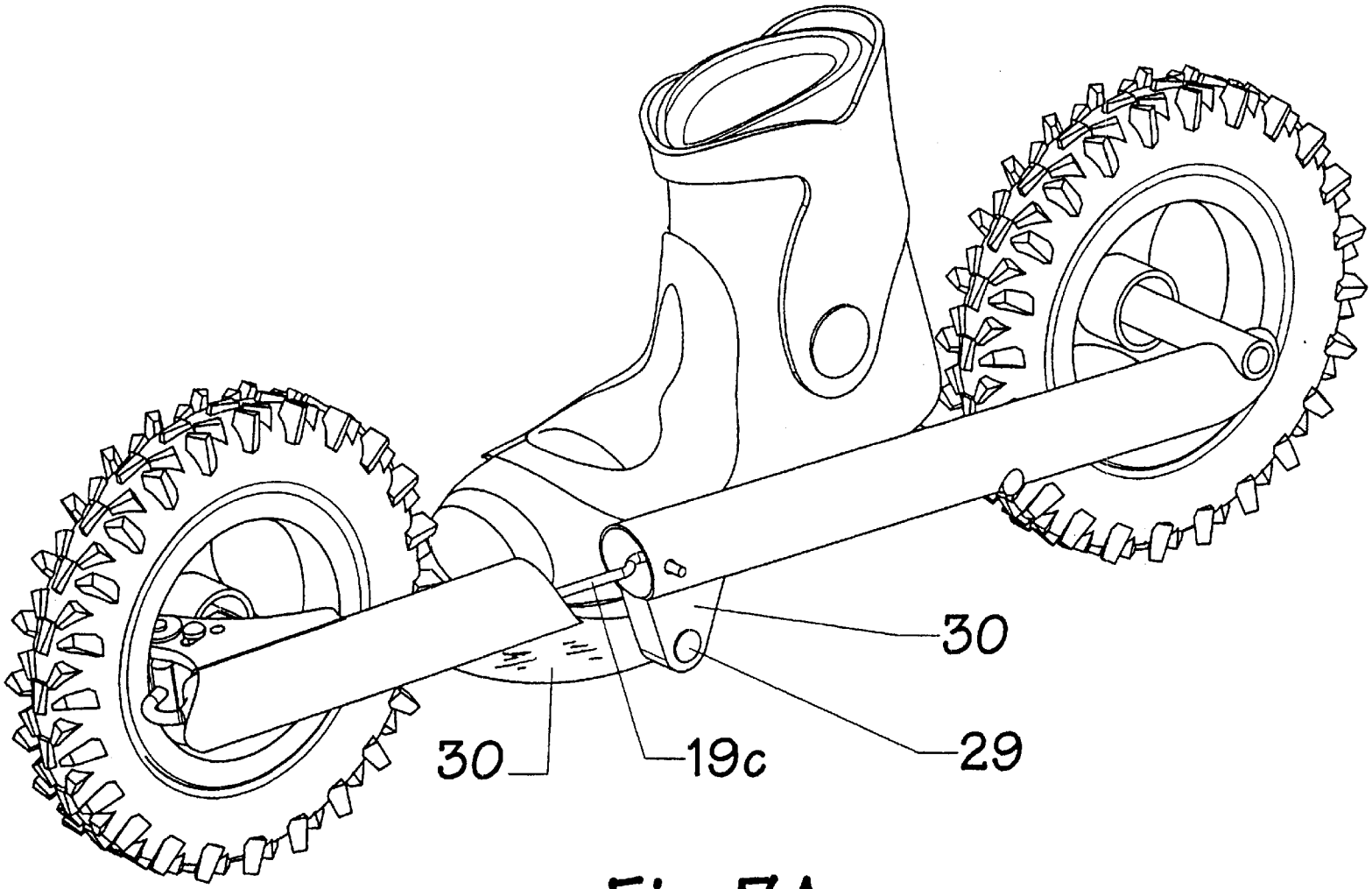
FIGS. 7A and 7B show views of a sporting device employing the damping mechanism as a suspension means for the chassis of the device.
Figure 7B:
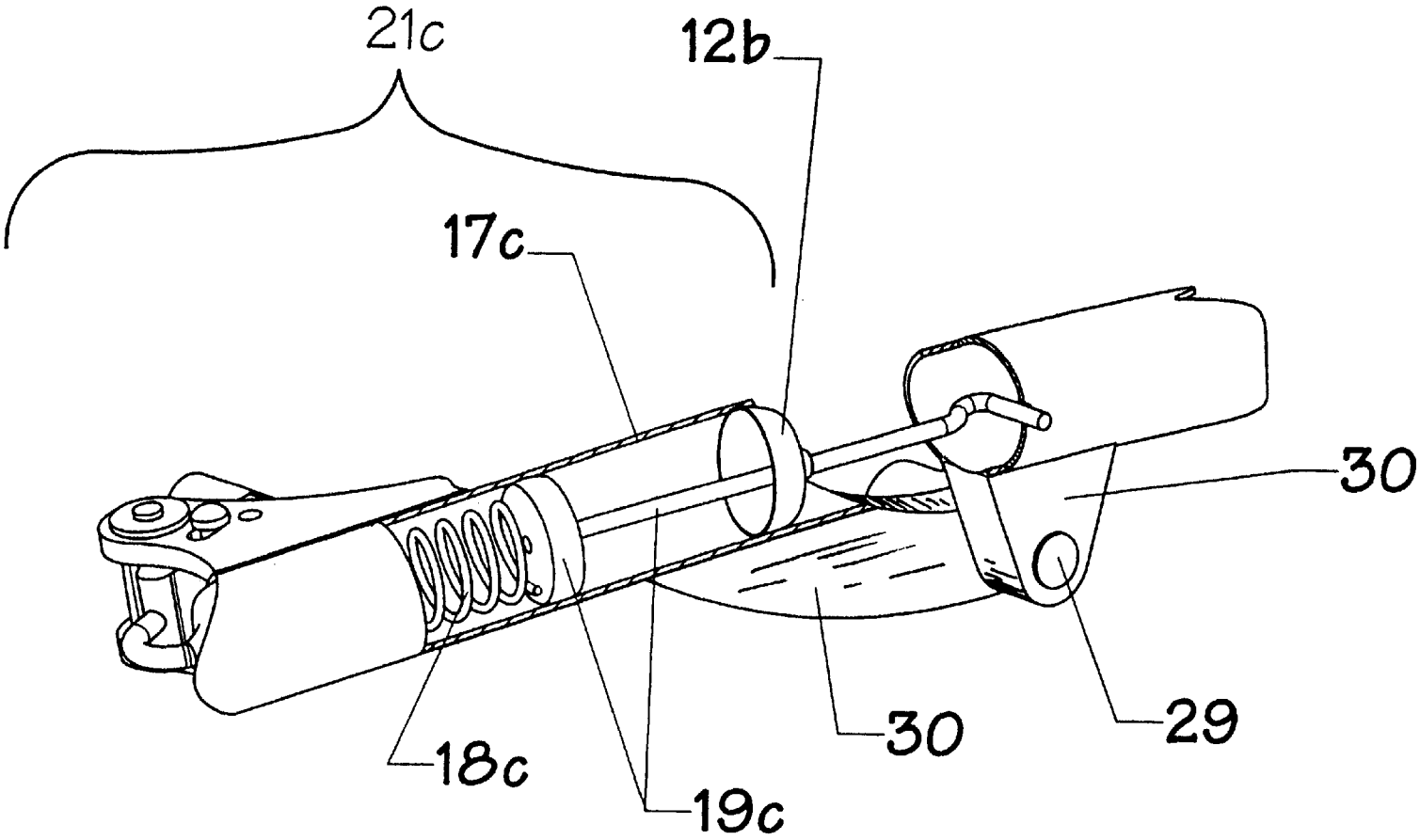

FIGS. 7A and 7B show an embodiment of the damping and centering force mechanism arranged so that it works with a suspension mechanism for a sporting device. The device shown here is similar to the skate or roller ski devices referred to above, but a configuration could easily be arranged that was part of many other devices such as a bicycle frame. The basic function of the suspension mechanism is to allow relative motion between parts of the chassis of the device when bumps or dips in the terrain are encountered. The result is that the forces and displacements transferred to the user are moderated.

In these figures, when the suspension mechanism is operated, the two parts of chassis 21*c* move relative to one another, causing piston 19*c* to slide inside of a housing 17*c*. Housing 17*c* is part of chassis 21*c,* or is rigidly attached to it. This motion causes a damping effect similar to the damping effect described in conjunction with the steering mechanism of this invention. This damping effect results in improved handling characteristics when the device is used on rough terrain. The suspension mechanism shown here also incorporates a centering force means 18*c* similar to the centering force means for the steering described above. Centering force means 18*c* is attached at one end to piston 19*c* and at the other end to chassis 21*c,* so that it expands or contracts as piston 19*c* moves and it applies forces which urge the chassis toward a neutral or centered position. In the figures centering force means 18*c* is depicted as a coil spring, although many other types of centering force means can be used. In FIGS. 7A and 7B, the forward part of chassis 21*c* which comprises housing 17*c* is pivotally mounted to rear part of chassis 21*c* via a suspension pivot 29. The mechanism could also be configured so that the parts of chassis 21*c* slide with respect to one another rather than pivoting. A third method for performing a similar function can be arranged with the use of a four-bar linkage mechanism joining the two halves of chassis 21*c*. It should also be noted that piston 19*c* can be configured to slide in either the forward or the rear portion of chassis 21*c*. Additionally, a separate, pre-existing damping mechanism could be incorporated into chassis 21*c* rather than using the inner surface of chassis 21*c* as the housing for piston 19*c*.

When the damping and centering force mechanism of the present invention is arranged to provide a suspension action, it can greatly improve the operational characteristics of the device that it is employed in. For a sporting device, specifically, the smoothness of the ride, the handling, and the range of terrain on which the device can be used will be improved.

FIGS. 2A to 2C, 3G, and 7A show skate/ski devices which employ a chassis structure that runs along one side of the foot and wheels, rather than under the foot and around both sides of the wheels as in most of the prior art devices. The configuration of running a structural member along the side of the foot is advantageous for the following reasons:

a) It allows the use of a single tube or other member for simplicity;

b) It facilitates making the device lightweight;

c) It similarly allows the manufacturing to be economical;

d) It allows the maximum possible ground clearance when bumps and debris are encountered; and e) It facilitates the use of mechanisms including, but not limited to the in-frame damping and centering force mechanism of this invention.

The steering mechanism of the present invention can be used to greatly improve the maneuverability and handling characteristics of a device, particularly a skate or roller ski. The use of the damping and centering force mechanism of the invention, either in conjunction with a steering mechanism, or a suspension mechanism can further enhance the performance of such a device. Additionally, such a device can be manufactured simply and inexpensively with the use of the one-sided chassis of this invention.

While my above description contains many specificities, these should not be construed as limitations on the scope of the invention, but rather as an exemplification of one preferred embodiment thereof. Many other variations are possible. For example, a one piece flexible member, flexure, or hinge could be used for the steering pivot, rather than the bearings shown in the figures; other linkages could be used to facilitate suspension action while still using the damping and centering force mechanism of the invention, and the one-sided frame could support the front wheel from the left side and the rear wheel from the right side, or vise-versa, while still passing by the foot substantially to one side as provided in the invention.

Accordingly, the scope of the invention should be determined not by the embodiments illustrated, but by the appended claims and their legal equivalents.

REFERENCE NUMERALS IN DRAWINGS

10 tire
11 wheel
12 damper sealing boot
13 wheel bearing means
14 wheel support means
15 kingpin rod
16 steering pivot means
17 damper housing
18 centering force means
19 damper piston
20 steering link
21 chassis
22 steering axis
23 tire patch
24 fluid chamber
25 connecting pin
26 steering stop pin
27 steering lockout hole
28 steering limit track
29 suspension pivot
30 suspension links
31 wheel rotation axis

What is claimed is:

1. A recreational wheel device having a chassis for supporting a user and having a front wheel assembly and a back wheel assembly mounted to the chassis, wherein at least one of said front and said back wheel assemblies is a steerable wheel assembly that includes only a single wheel, said single wheel being a steerable wheel that steers about a steering axis and has a rotation axis said single wheel having an outer radius a wheel bearing having a bearing outer radius and mounting said steerable wheel to rotate about said rotation axis a steering pivot assembly substantially disposed within the outer radius of said steerable wheel and extending radially beyond said bearing outer radius of the wheel bearing and a wheel support assembly structurally carrying the wheel bearing, said wheel support assembly being mounted to pivot on the steering pivot assembly about the steering axis such that the steerable wheel responds to weight distribution of a rider supported on the chassis to actively steer the device.

2. The recreational wheel device of claim 1, wherein said device is a device selected from the group consisting of a skate, a skateboard and an in-line ski.

3. The recreational device of claim 1, wherein said device comprises a fixed non-steerable wheel.

4. The recreational wheel device of claim 1, wherein said steerable wheel is cantilevered from said chassis.

5. The recreational device of claim 4, wherein said chassis extends along a single side of a users foot.

6. The recreational device of claim 1, further comprising a damping assembly for modulating movement of the wheel support assembly as said steerable wheel steers.

7. The recreational device of claim 6, wherein said damping assembly resides within and is protected by the chassis.

8. The recreational device of claim 1, wherein said steering pivot comprises a kingpin aligned proximate the plane of rotation of said wheel.

9. The recreational device of claim 1, further comprising a mechanism effective to limit rotation of said wheel to one direction thereby allowing the user to propel the device by pushing.

10. The recreational device of claim 1, wherein the steering pivot pivots about a pivot axis that intersects a surface of the groung near a center plane of rotation of said wheel.

11. The recreational device of claim 1, wherein said wheel includes a tire selected from the group consisting of pneumatic tires, solid tires made of resilient material, and tires filled with a foam material.

12. The recreational device of claim 1, further comprising a brake assembly.

13. The recreational device of claim 1, further comprising a centering assembly for exerting restoring force to center the steerable wheel.

14. The recreational device of claim 1, further comprising a locking mechanism effective to position said steerable wheel in a fixed alignment.

15. The recreational device of claim 1, wherein the chassis includes a structural member, and further comprising a damping and restoring force assembly within said structural member and coupled to modulate movement of said wheel assembly.

16. The recreational device of claim 1, wherein the chassis includes a primary structural or load bearing member disposed to run substantially along a single side of the user's foot.

* * * * *